US005854143A

United States Patent [19]

Schuster et al.

[11] Patent Number: 5,854,143

[45] Date of Patent: Dec. 29, 1998

[54] MATERIAL FOR ANTIBALLISTIC PROTECTIVE CLOTHING

[75] Inventors: Dieter Hans Peter Schuster; Achim Gustav Fels, both of Wuppertal, Germany

[73] Assignee: Akzo Nobel NV, Arnhem, Netherlands

[21] Appl. No.: 794,540

[22] Filed: Feb. 3, 1997

Related U.S. Application Data

[63] Continuation of Ser. No. 347,112, Nov. 23, 1994, abandoned.

[30] Foreign Application Priority Data

Nov. 25, 1993 [DE] Germany ..... 43 40 172.4

[51] Int. Cl.[6] ..... B32B 7/00; B32B 3/26

[52] U.S. Cl. ..... 442/135; 442/103; 442/165; 442/169; 442/170; 428/304.4; 428/911

[58] Field of Search ..... 442/103, 135, 442/165, 169, 170; 428/304.4, 911

[56] References Cited

U.S. PATENT DOCUMENTS

| | | | |
|---|---|---|---|
| 3,649,426 | 3/1972 | Gates, Jr. . | |
| 4,031,053 | 6/1977 | Bunkley et al. | 260/29.6 R |
| 4,475,247 | 10/1984 | Lee | 2/2.5 |
| 4,774,724 | 10/1988 | Sacks . | |
| 5,104,717 | 4/1992 | Landa et al. | 428/141 |
| 5,184,411 | 2/1993 | Corletto . | |
| 5,418,271 | 5/1995 | Burba, III et al. | 524/436 |

FOREIGN PATENT DOCUMENTS

| | | |
|---|---|---|
| 2 469 277 | 5/1981 | France . |
| 2 038 712 | 7/1980 | United Kingdom . |
| 2 210 773 | 6/1989 | United Kingdom . |
| 2 234 156 | 1/1991 | United Kingdom . |
| WO 92/06841 | 4/1992 | WIPO . |
| WO 92/08095 | 5/1992 | WIPO . |

*Primary Examiner*—Helen L. Pezzuto
*Attorney, Agent, or Firm*—Oliff & Berridge, PLC

[57] ABSTRACT

Material for antiballistic protective clothing comprising in a single-layer or multi-layer package or laminate at least one layer of a flat structure containing an organic dilatancy agent This flat structure is particularly suited for a trauma package in an antiballistic package. The flat structure with a dilatancy agent results in a significant improvement in the antiballistic effect and, in particular, a reduction in the trauma effect. The material finds special application for bullet-proof and splinter-proof vests and correspondingly for helmets. Moreover, the material of the invention can be used in clothing protecting against impact.

10 Claims, No Drawings

MATERIAL FOR ANTIBALLISTIC PROTECTIVE CLOTHING

This is a Continuation of application Ser. No. 08/347,112 filed Nov. 23, 1994, now abandoned.

FIELD OF THE INVENTION

The invention relates to a material for protective clothing, in particular antiballistic protective clothing, in the form of single-layer or multi-layer packages or laminates.

BACKGROUND

Numerous materials and designs have been proposed for the protection of persons against injury from projectiles, especially that resulting from the impact of projectiles and splinters on the body at high velocity. Among the materials, textile flat structures, particularly woven fabrics made from aramid fibers, are frequently encountered. The designs relate particularly to so-called antiballistic packages, that is, packages of multiple superimposed thin flat structures, predominantly woven fabrics, that are glued, pressed, sewn, or quilted together.

In the case of materials for protecting persons, it is important to provide lightweight products with maximum wearing comfort. However, a compromise must be made in this case between antiballistic effectiveness, i.e., the protective action for the person requiring protection, and wearing comfort. In this regard, it is known that the increase in the number of layers or the weight per unit area of the individual layers can improve the protective action in most cases. This leads, however, to heavier antiballistic protective clothing and in turn to reduced wearing comfort.

The so-called trauma package enjoys special importance for protective clothing. A projectile impacting a piece of protective clothing worn on the body is slowed by the layers of the antiballistic package such that it cannot penetrate the body and cause injury to the wearer of the protective clothing. However, the impact of the projectile causes a certain shock effect and possibly a trauma as a result. The trauma package, which in the antiballistic package is adjacent to the body, is intended to alleviate this effect.

Various embodiments for the design of this trauma package have been proposed. GB-A 2 234 156 provides for a layer of moldable plastic secured to a fabric made from antiballistically effective material.

A trauma package introduced into a fabric jacket made from aliphatic polyamide fibers and comprising a layer of a fabric made from antiballistically effective fibers, a layer of a flexible, semi-rigid polycarbonate, and multiple layers of a foamed material with good compressibility is proposed in U.S. Pat. No. 4,774,724.

Furthermore, rubberized layers of antiballistically effective fabrics, pressed together, are also used for trauma packages.

In most cases, however, the embodiments proposed until now for reducing trauma upon projectile impact do not exhibit the desired effectiveness. Some of the proposed solutions to the problem considerably reduce the wearing comfort of protective clothing, since the special anti-trauma layers result in a not insignificant increase in not only the weight and thickness but above all the rigidity of protective clothing.

For this reason, the objective has been made to develop materials for protective clothing with the same or reduced weight, greater flexibility, and improved anti-trauma effectiveness.

It has now been discovered that this objective can be met in a particularly advantageous manner if in antiballistic clothing one or more layers of the antiballistic package, and particularly the trauma package, comprise flat structures containing an organic dilatancy agent.

The use of dilatant materials in ballistics has previously been disclosed in U.S. Pat. No. 3,649,426. This patent proposes flat structures for protective clothing, for example, that are produced by compressing dilatant mixtures. Such mixtures are those of inorganic materials such as metal oxides or silicon dioxide powder with liquids having a dipole character. In this case, the problem arises that, through compression, the liquid is removed from the dilatant system to a great extent and the desired effect is partially lost. However, if a reduced compression that largely retains the liquid phase is performed, the dimensional stability of these articles is fully inadequate when worn as protective clothing.

Moreover, use of the dilatant systems proposed in U.S. Pat. No. 3,649,426 for protective clothing results in diminished wearing comfort due to the weight increase caused by the compressed panels. Furthermore, as will be shown in more detail in the comparative example, infra, only a slight antiballistic effect can be attained using the embodiment described in the cited patent.

SUMMARY OF THE INVENTION

The stated disadvantages can be circumvented if individual layers of the antiballistic package and, in particular, one or more layers of the trauma package comprise a flat structure that has been saturated or charged with organic dilatancy agents.

DETAILED DESCRIPTION OF PREFERRED EMBODIMENTS

The phenomenon of dilatancy has not yet been satisfactorily explained. It is generally understood to mean the stiffening or change in volume of a substance due to a sudden mechanical stress, particularly the action of shearing forces or the impression of a shear gradient, whereby time influences or effects cannot be measured.

Under a sudden mechanical influence, such as the impact of a projectile, a volume change resulting from combined shear and compression stress occurs and leads to a sharp increase in transmittable shear forces.

For purposes of the invention, substances imparting dilatancy are understood to be all substances that, as a result of a sudden mechanical influence, undergo a stiffening or volume change in the manner previously described.

The best known examples of dilatant systems are mixtures of quartz sand and water. Water is frequently used to form the liquid phase, but other liquids with dipole character can be employed for this purpose. As the comparative example will show, such systems are poorly suited for protective clothing.

There are also organic compounds that are known to have dilatant properties. Polymers suitable for dilatant systems are styrene and its derivatives. Particularly suitable are copolymers of styrene with acrylic acid or methylacrylic acid or their esters. In addition, other copolymers of styrene and of compounds of polyacrylic or polymethylacrylic acid are appropriate for this field of application. Other applicable products are polyvinyl chloride and polyvinylidene chloride, as well as the respective copolymers.

The polymers listed here are well suited for manufacturing materials in accordance with the invention. However, those cited should be considered as examples only and not as restrictive. Within the scope of the invention, all organic compounds that, through saturation or charging, impart properties of dilatancy on a flat structure can be used for manufacturing materials in accordance with the invention.

The dilatancy-imparting polymers are preferably applied in the form of dispersions to flat structures intended for processing into protective clothing. Such dispersions, available as commercial products, frequently contain, in addition to the polymer and water, additional products such as alkyl esters of phthalic acid.

The flat structures envisioned for protective clothing and containing a dilatancy agent are preferably textile flat structures with good affinity for polymer dispersions. Nonwoven fabrics are especially well suited for this purpose.

Spunbonded fabrics or nonwovens produced from spinnable fibers or short fibers are equally usable.

There are no restrictions on fiber type for the manufacture of the nonwoven fabric. Nonwovens made from polyester or polyamide fibers are well suited, but nonwovens made from other synthetic fibers or from native or regenerated cellulose fibers can also be employed. Furthermore, aramid fibers, often referred to as aromatic polyamide fibers, and frequently used in antiballistic protective clothing, can also find application as fiber material for producing the nonwoven fabrics. Another fiber with good antiballistic effectiveness that can be used to manufacture such a nonwoven fabric is polyethylene fiber spun using a gel spinning process.

In addition to nonwoven fabrics, which are preferably used as carriers for the dilatancy agent in manufacturing materials in accordance with the invention, other textile flat structures such as woven fabrics, knitted fabrics, thread composites, stitch-bonded textiles, and others can be used as carriers for the dilatancy agent. It is important that there be good affinity for the dispersion containing the dilatancy agent. Also suited as such carriers are non-textile flat structures such as foamed materials. The best results with respect to antiballistic effectiveness have been attained with nonwoven fabrics as carriers for the substance exhibiting dilatancy. Due also to the usually low initial weight, these are particularly suitable for protective clothing.

The flat structure to receive the dilatancy-imparting dispersion is saturated with the dispersion and squeezed slightly. Since a large quantity of the dilatancy agent is required on the carrier material, high bath concentrations are necessary. For example, a steeping bath for finishing a carrier material is prepared using approximately equal parts of water and a commercial dispersion of the dilatancy agent. Depending on the desired effect, method of application, and solids content of the dispersion of the dilatancy agent, however, the ratio of water to dispersion of the dilatancy agent in the treatment bath can vary from 3:7 to 7:3, for example. As are the percentages cited below, the values given here are examples only and are not to be considered restrictive.

Especially suitable for applying the dilatancy agent on the carrier material are so-called padding processes, which can be conducted continuously such as on a padding machine. These processes are well known in textile finishing. A special variant is represented by padding processes in which the treatment bath is not located in a pad box, but rather in a nip formed by the squeezing rollers. Another application possibility is the use of slop-padding processes, which are likewise well known in the textile finishing art.

In addition to application in a bath in conventional form, foam application is also possible. This method is also well known in the textile finishing art.

Following application of the dilatancy agent to the carrier material, squeezing is conducted, for example, using a pair of rollers as are present on a padding machine. The degree of squeezing following wet treatment is adjusted, for example, such that the finished carrier material retains approximately 30–70% of the applied dispersion after squeezing.

With a bath concentration of 50% dispersion, the weight increase of the treated carrier material following squeezing must therefore be approximately 60–140% with respect to the dry carrier material.

In addition to those mentioned, however, there are other possible methods of applying the dilatancy agent to the carrier material. For example, it can be sprayed or poured on. In this case as well, the aforementioned concentrations can be employed.

When using chemical fibers for manufacturing carrier materials, the dilatancy agent can even be applied during the fiber manufacturing process, together with a finishing agent, for example.

The flat structures finished with a dilatancy agent can be applied in protective clothing in that wet or dry state. Use in the dry state is preferred. In this case, it is necessary to dry finish flat structures following wet treatment. This drying step should take place under gentle conditions, that is, at relatively low temperatures. The drying temperature depends on the type of polymer used. For example, the drying temperature in the case of polystyrene or its copolymers must not exceed 80° C.

In addition to the preferred dry-state application for flat structures provided with a dilatancy agent, use in the wet state is also possible. In this case, the same concentrations for the dispersion containing the dilatancy agent are used as for the dry state. In a wet-state application, the flat structure finished with a dilatancy agent must be sealed in a damp-proof jacket, made of sheet polyethylene, for example. In this form, the flat structure finished with a dilatancy agent is incorporated as a layer in the antiballistic package.

The flat structures finished with a dilatancy agent can be used in various forms for protective clothing. A preferred application of these materials of the invention is in antiballistic protective clothing, especially preferred as a trauma layer in antiballistic protective clothing. Such antiballistic protective clothing is worn in the form of vests, for example, often referred to a bulletproof vests. The actual protective layer in these vests is formed by the so-called antiballistic package, which frequently comprises a large number of superimposed layers of aramid fiber fabrics that are sewn, quilted, glued, or pressed together. Packages with 28 such layers are common in bulletproof vests, for example.

In accordance with prevailing terminology, layers that are quilted or sewn are normally referred to as "packages", while pressed or glued layers are often termed "laminates". The term "package", however, can also be considered a general term for all methods of strengthening.

With such vests, for example, a flat structure finished with a dilatancy agent can be inserted into the antiballistic package, whereby this flat structure can serve as one of a total 28 layers of such a package, for example, or as an additional layer. The other layers comprise, for example, fabrics made from aromatic polyamide fibers with a weight per unit area of approximately 200 g/m$^2$. The invention, however, is not limited to the use of only one layer of a flat structure containing a dilatancy agent. Depending on the desired effect, the antiballistic package can comprise multiple layers of these flat structures. The number of conventional fabric layers may be reducible through the use of multiple layers of flat structures containing a dilatancy agent.

The flat structure containing a dilatancy agent is especially preferred for inclusion in the trauma package, that is, in the layers of the antiballistic package next to the body. When this flat structure is in the trauma layers of the antiballistic package, it functions as a form of shock absorber. The trauma effect occurring upon impact of a projectile can be reduced considerably by positioning a flat structure finished with a dilatancy agent close to the body. Good antiballistic effectiveness and reduction of the trauma effect are also observed, however, when the flat structure containing a dilatancy agent is positioned in an antiballistic package layer that is farther from the body. For example, an especially good antiballistic and anti-trauma effect can be achieved when at least one flat structure containing a dilatancy agent is used in the trauma package as well as in a layer farther from the body.

The special trauma layers cited are particularly common for protective clothing in the form of bulletproof vests. In the same manner, however, a special trauma layer can be formed in a helmet using a flat structure containing a dilatancy agent.

The statements made here concerning the positioning of flat structures containing a dilatancy agent apply likewise to the dry-state and wet-state applications of these flat structures.

A particularly advantageous effect of a flat structure finished with a dilatancy agent when used in the trauma package is observed when a so-called support layer is used behind the trauma package, as viewed from the outside. In an especially preferred embodiment, this support layer is an aramid fiber fabric, as in the case of the antiballistic package. In the same manner, however, other fabrics made from high-strength fibers, particularly those with antiballistic effectiveness, can be used as support layers. In addition to aramid fiber fabrics, fabrics made from high-strength fibers spun using a gel spinning process are especially suitable in this case. Other fabrics made from other fibers such as carbon, polyester, or polyamide can be used as support layers, however. In addition to fabrics, other textile flat structures can find application as support layers.

The flat structure used as a support layer, such as a fabric woven from aramid fibers, is normally not finished with a dilatancy agent. It is possible, however, to finish the flat structure of the support layer with such an agent.

Due to the cited advantages, the material of the invention is especially suited for bulletproof and splinterproof vests, and for corresponding protective suits. In the same manner, however, it can also be used for antiballistically effective helmets.

A further possible application of the material of the invention is for clothing to protect against impact, as is sometimes worn by athletes but also as occupational safety clothing. The phenomenon of dilatancy is exploited in a manner similar to that for antiballistic protective clothing.

As has been shown, and as the embodiments will further confirm, the material of the invention provides a significant degree of protection in protective clothing. This is especially true for antiballistic protective clothing, in which the significantly increased protective action is not accompanied by any impairment of wearing comfort. The material of the invention has proven particularly suited as a shock absorber in the antiballistic package, that is, in reducing the trauma effect.

COMPARATIVE EXAMPLE 1 AND EXAMPLE 1

In this example, the teachings of U.S. Pat. No. 3,649,426 are employed for the antiballistic protective clothing application of Comparative Example 1. For this purpose, the mixture cited therein of 80% quartz sand, 16% glycerine, and 4% water is used. This mixture is introduced in the form of a 20 mm thick molded body into a jacket of sheet polyethylene and subjected to a bombardment test. This thickness represents an extreme case for antiballistic protective clothing. Normally, the thicknesses of antiballistic layers for bulletproof vests lie between 5 and 15 mm.

The bombardment of the polyethylene-enclosed molded body of the cited mixture is undertaken with 9 mm Para ammunition (FMJ). Even at a projectile velocity of 200 m/sec, this package is completely penetrated. In the case of a standard antiballistic package comprising, for example, 28 layers of an aramid fabric with approximately 200 g/m$^2$ weight per unit area, total penetration occurs only in excess 460 m/sec.

In Example 1, one layer of this 28-layer package is replaced by a polyester nonwoven finished with a dilatancy agent in accordance with the invention, such that there are 27 layers of aramid fabric and one layer of polyester nonwoven finished with a dilatancy agent. For the jacket of Example 1, total penetration does not occur until a velocity of 510 m/sec.

These results show that the inorganic material proposed in the art for imparting dilatancy is unsuitable for antiballistic protective clothing. The molded body produced in accordance with U.S. Pat. No. 3,649,426 exhibits completely unsatisfactory antiballistic properties at a thickness significantly exceeding that of the antiballistic package comprising unfinished aramid fabrics. Due to the considerable thickness of the molded body, its combination with aramid fabrics cannot be considered for antiballistic protective clothing.

EXAMPLE 2

For this example, the finishing of a nonwoven fabric with a dilatancy agent will be described.

A nonwoven fabric manufactured by a carding process from polyester spinnable fibers with a titer of 3.3 dtex and a cut length of 60 mm and strengthened with a bonding agent is employed for finishing. The weight per unit area of the nonwoven is 102 g/m$^2$. This nonwoven is finished on a laboratory padding machine. The preparation in the pad box of the padding machine contained 50% of Dilatal DS 2277 X from BASF of Ludwigshafen, Germany, a commercial dispersion of a copolymer of styrene and ethyl acrylate basis, with a diallylphthalate additive. The solids content of the dispersion is approximately 68%, and the bath preparation thus has a solids contents of approximately 34%. The degree of squeezing is set to 120%, that is, the total weight of the nonwoven after squeezing consists of 1 part nonwoven weight and 1.2 parts water and solids from the dispersion. Subsequently, drying is conducted on a laboratory dryer at 80° C. After drying, the weight per unit area is 143 g/m$^2$.

EXAMPLE 3 AND COMPARATIVE EXAMPLE 2

The nonwoven finished in accordance with Example 2 is integrated into a bulletproof vest comprising 28 layers of an aramid fiber with a weight per unit area of 198 g/m$^2$, whereby the nonwoven is employed for layers 29 and 30, next to the body. Moreover, an additional layer of an unfinished aramid fabric with a weight per unit area of 198 g/m$^2$ is incorporated as layer 31 behind the two nonwoven layer, as a so-called support layer. The structure from outside to inside therefore comprises: 28 aramid fabric layers, 2 layers of a nonwoven finished with a dilatancy agent, and 1 aramid fabric layer as a support layer.

In the bombardment test with 9 mm Para ammunition (FMJ), also used in the bombardment tests described below, and at a projectile velocity of 420 m/sec, the penetration depth of the projectile into plastilina positioned behind the antiballistic package is 10 mm. In a further bombardment test of this bulletproof vest, the projectile velocity is increased to 510 m/sec. In this case, the penetration depth into plastilina is 14 mm.

Under the same bombardment conditions, a comparative bombardment test conducted with an antiballistic package comprising only 28 layers of the aforementioned aramid fabric results in a penetration depth of 38 mm into plastilina at a projectile velocity of 420 m/sec. At 510 m/sec, the projectile totally penetrates the antiballistic package.

The determination of the penetration depth into a plastilina layer serves as a test of the trauma effect. For this purpose, the plastilina layer is positioned behind the antiballistic package. The penetration depth into plastilina is often also referred to as the trauma depth. Depending on the country, the trauma depths permitted by the authorities range from 20 to 44 mm penetration into plastilina at a projectile velocity of, for example, 420 m/sec.

The test described here not only demonstrates a significant decrease in the trauma effect by using the material of the invention; it also shows that the sometimes quite stringent requirements with respect to trauma depth can be achieved only by using the material of the invention in the trauma layer of an antiballistic package.

COMPARATIVE EXAMPLE 3 AND EXAMPLES 4 AND 5

Comparative Example 3 and Examples 4 and 5 show the positive effect of the support layer in an antiballistic package. In Comparative Example 3, a package of 28 layers of an aramid fabric with a weight per unit area of 202 g/m$^2$ is subjected to a bombardment test at a projectile velocity of 420 m/sec. The penetration depth into plastilina in this case is 37 mm.

For the second bombardment test, i.e., Example 4, 6 layers of a lightweight polyester nonwoven finished with a dilatancy agent are positioned behind the package comprising 28 layers of an aramid fabric. The nonwoven has a weight per unit area of 118 g/m$^2$ after finishing (unfinished weight per unit area 81 g/m$^2$). From outside to inside, the package therefore is structured as follows: 28 layers of aramid fabric and 6 layers of polyester nonwoven. With this package, the penetration depth in the bombardment test at 420 m/sec projectile velocity is 13 mm.

For the third bombardment test, i.e., Example 5, an additional layer of unfinished aramid fabric as a so-called support layer is positioned behind the nonwoven layers, such that the package now has the following structure from outside to inside: 28 layers of aramid fabric, 6 layers of a polyester nonwoven woven finished with a dilatancy agent, and 1 layer of aramid fabric as a support layer. In a bombardment test at 420 m/sec projectile velocity, the penetration depth is only 6 mm.

While the invention has been described in detail and with reference to specific examples thereof, it will be apparent to one skilled in the art that various changes and modifications can be made therein without departing from the spirit and scope thereof.

What is claimed is:

1. A material for protective clothing comprising a plurality of layers integrated into said protective clothing in a form of a package or a laminate, wherein at least one layer of said plurality of layers consists of a flat structure having dilatant properties and the flat structure consists of:

at least one organic compound which imparts the dilatant properties to the flat structure and a member selected from the group consisting of a textile member and a non-textile member, wherein the member is saturated or charged with the at least one organic compound.

2. The material for protective clothing according to claim 1, wherein said at least one organic compound is applied to said flat structure by impregnation, foam application, spraying or pouring.

3. The material for protective clothing according to claim 1, wherein said textile member is selected from the group consisting of nonwoven fabric, woven fabric, knitted fabric, thread composite and stitch-bonded fabric.

4. The material for protective clothing according to claim 1, wherein said non-textile member consists of foamed material.

5. The material for protective clothing according to claim 1, wherein said at least one organic compound is selected from the group consisting of styrene polymers, polyvinyl chlorides and polyvinylidene chlorides.

6. The material for protective clothing according to claim 1, wherein said at least one organic compound is a copolymer of styrene with a member selected from the group consisting of acrylic acid, acrylic acid ester, methylacrylic acid, methylacrylic acid ester, polyacrylic acid and polymethylacrylic acid.

7. The material for protective clothing according to claim 1, wherein substantially all of said at least one organic compound in said material adheres to said flat structure.

8. The material for protective clothing according to claim 1, wherein the at least one organic compound is a polymer.

9. A material for protective clothing comprising a flat structure having dilatant properties, wherein the flat structure consists of:

at least one organic compound, which imparts the dilatant properties to the flat structure, and a foamed material flat structure, wherein the foamed material flat structure is saturated or charged with the at least one organic compound.

10. The material for protective clothing according to claim 9, wherein the at least one organic compound is a polymer.

* * * * *

UNITED STATES PATENT AND TRADEMARK OFFICE

CERTIFICATE OF CORRECTION

PATENT NO. : 5,854,143

DATED : December 29, 1998

INVENTOR(S) : Dieter Hans Peter SCHUSTER and Achim Gustav FELS

It is certified that error appears in the above-indentified patent and that said Letters Patent is hereby corrected as shown below:

Title page, in item [57] ABSTRACT, line 3, after "agent" insert --.--.

Column 8, line 15, after "properties" insert --,--;

line 16, after "compound" insert --,--; and line 17, after "structure" insert --,--.

Signed and Sealed this

Twentieth Day of April, 1999

*Attest:*

Q. TODD DICKINSON

*Attesting Officer*

*Acting Commissioner of Patents and Trademarks*